US006257468B1

(12) United States Patent
Yamazoe et al.

(10) Patent No.: US 6,257,468 B1
(45) Date of Patent: Jul. 10, 2001

(54) BABY CARRIER

(75) Inventors: Fumiyo Yamazoe; Kenzou Kassai, both of Osaka (JP)

(73) Assignee: Aprica Kassai Kabushikikaisha, Osaka (JP)

( * ) Notice: Subject to any disclaimer, the term of this patent is extended or adjusted under 35 U.S.C. 154(b) by 0 days.

(21) Appl. No.: 09/239,465

(22) Filed: Jan. 28, 1999

(30) Foreign Application Priority Data

Jan. 28, 1998 (JP) ..... 10-030556
Dec. 24, 1998 (JP) ..... 10-365900

(51) Int. Cl.[7] ..... A61G 1/00
(52) U.S. Cl. ..... 224/158; 224/159; 224/160
(58) Field of Search ..... 224/158, 159, 224/160, 153

(56) References Cited

U.S. PATENT DOCUMENTS 5,071,047 12/1991 Cordisco .
5,205,451 4/1993 Manzer .
5,246,152 9/1993 Dotseth .
5,690,258 11/1997 Kataoka .
6,045,018 * 4/2000 Onishi ..... 224/158

FOREIGN PATENT DOCUMENTS 8150051 6/1996 (JP) .

* cited by examiner

*Primary Examiner*—Gregory M. Vidovich
*Assistant Examiner*—Maerena W. Brevard
(74) *Attorney, Agent, or Firm*—W. F. Fasse; W. G. Fasse

(57) ABSTRACT

A baby carrier 1 comprises a carrier body 2 having a front cover portion 3, a crotch cover portion 4 and a back cover portion 5, which are integrally formed in continuation, shoulder belts 6, 7 extending upwardly from the back cover portion 5, one-touch buckles 12, 13 at the ends of the shoulder belts 6, 7, and cover-equipped buckles 20, 21 beside the front cover portion 3 which engage with the one-touch buckles 12, 13. A baby carrier 1 further comprises hook members 31, 32 beside the front cover portion 3, annular members 28, 29, and 28', 29'on the back cover portion 5 which engage with the hook members 31, 32. Moreover, there are provided a head support 8 for supporting a baby's head, and a head guard 9 for protecting the top portion of a baby's head, which is able to fold toward the back side of a head support 8 and stand up toward the baby's side. Thereby, the changing operation between a longitudinal support type and a lateral support type of a baby carrier 1 can be performed with ease, and a baby can be prevented from falling down when it is held laterally or sideways.

23 Claims, 17 Drawing Sheets

PRIOR ART

PRIOR ART

BABY CARRIER

CROSS-REFERENCE TO RELATED APPLICATION

The present application relates to copending, commonly assigned application U. S. Ser. No. 09/024,066, filed on Feb. 17, 1998, now U. S. Pat. No. 6,045,018, issued on Apr. 4, 2000.

FIELD OF THE INVENTION

The present invention relates to a baby carrier for carrying a baby while holding the baby in the carrier. The invention also relates to a head support for the baby carrier for supporting a baby's head.

BACKGROUND INFORMATION

A baby carrier with the functions of both lateral and longitudinal support is generally used, as shown in FIGS. 17–20. These figures show the same baby carrier that can be used for lateral support of a baby, as shown in FIGS. 17 and 19, and for longitudinal support of a baby, as shown in FIGS. 18 and 20, by changing the connections of each support belt.

The known baby carrier 100 has a carrier body 101, where a headrest portion 102 and a backrest portion 103 for holding a baby's head and back, respectively, are integrally formed as one piece. The carrier body 101 is fitted with belts A–G.

When the baby carrier 100 is used for lateral support, as shown in FIG. 17, an end of the belt C is fastened onto the belt A by a snap fastener and the buckle at the end of the belt G is engaged with the buckle at the end of the belt F. Then, the buckle at the end of the belt A is engaged with the buckle at the end of the belt D to form the shoulder belt 104.

In this condition, a baby is placed on the carrier body 101 and the shoulder belt 104 is placed at an angle onto one shoulder of a carrying person (see FIG. 19). Then, the belt E is wound around the hip of the carrying person and the buckle at the end of the belt E is engaged with the buckle at the end of the belt B to form the waist belt 105 for holding the carrier body 101 on the hip of the carrying person.

On the other hand, when the baby carrier 100 is used for longitudinal support, as shown in FIG. 18, the end of the belt G is fastened to the belt A by a snap fastener and the buckle at the end of the belt A is engaged with the buckle at the end of the belt D to form the shoulder belt 104'.

Next, with a baby placed on the carrier body 101, the buckles of the belts B and C are engaged with each other for holding a baby on the carrier body 101. In this condition, the shoulder belt 104' is placed at an angle onto one shoulder of a carrying person (see FIG. 20). Then, the belt E is wound around the carrying person's hip and the buckle at the end of the belt E is engaged with the buckle at the end of the belt F to form the waist belt 105' for holding the carrier body 101 on the hip of the carrying person.

Thus, the conventional baby carrier is used either for lateral support or longitudinal support by changing the fastening conditions of the multiple belts. The belt changing operation between lateral support and longitudinal support is very complex and troublesome. Furthermore, when a baby is supported sideways, as shown in FIG. 19, it is merely placed on the carrier body 101, and thus, it may fall down.

OBJECTS OF THE INVENTION

The present invention is directed to solving the above-mentioned problems. One object of the present invention is to offer a baby carrier with a very simple changing operation between lateral support and longitudinal support states. Another object of the present invention is to offer a baby carrier with a very simple changing operation between longitudinal support and lateral support. In both instances the carrier must securely prevent a baby form falling down from both a baby's head side and a baby's leg side when it is supported sideways or upright. Yet another object of the invention is to offer a head support for a baby carrier, where a baby's head can be effectively protected against an impact load. A further object of the invention is to offer a head support for a baby carrier, which can securely prevent a baby from falling down from a head side of the respective carrier.

SUMMARY OF THE INVENTION

The present invention provides a baby carrier for supporting and carrying a baby therein and also provides a head support for a baby carrier for supporting a baby's head.

In one embodiment, the present baby carrier comprises a carrier body for receiving and holding a baby, a head support provided in the carrier body for supporting a baby's head, and a head guard provided at the end of the head support for protecting the top portion of a baby's head. When a baby is positioned in the carrier, the head guard extends away from the carrier toward the top of a baby's head.

In a second embodiment, a baby carrier comprises a carrier body having a front cover portion, a narrow crotch cover portion and a back cover portion, which are integrally formed as a one piece component, for supporting a baby's abdomen, crotch, and back, respectively. When the present carrier is assembled, the front cover portion is folded toward the back cover portion and the crotch cover portion is formed as a bag. The present baby carrier further comprises a shoulder belt provided at the carrier body, a head support provided at the back cover portion for supporting a baby's head, and a head guard provided at the end of the head support for protecting the top of a baby's head. In use the head guard extends from the top of the back cover portion toward the top of a baby's head.

In a third embodiment, the present baby carrier comprises a carrier body having a front cover portion, a narrow crotch cover portion and a back cover portion, which are integrally formed as one piece for supporting a baby's abdomen, crotch, and back, respectively. A pair of shoulder belts are provided at opposite ends of the back cover portion. Further, the baby carrier includes first buckles provided at the distal ends of shoulder belts formed by first belt members, and second buckles provided at the opposite ends of the front cover portion by second belt members. The second buckles are releasably engagable with the first buckles. Hook members are provided at the opposite ends of the front cover portion for third belt members. At least a pair of annular members is provided at the back cover portion. The annular members are releasably engagable with the hook members. A head support is provided at the back cover portion for supporting a baby's head. A head guard is provided at the end of the head support for protecting the top of a baby's head. In use the head guard extends toward the top of a baby's head.

A fourth embodiment provides a baby carrier according to the first to third embodiments, wherein the head support is releasably engagable with the carrier body or the back cover portion.

A fifth embodiment provides a baby carrier according to the first to third embodiments, wherein a belt piece is provided at the outside of the head support for guiding a carrying person's hand.

A sixth embodiment provides a baby carrier according to the first to third embodiments, wherein the head guard is fixed to the back side of the head support. The head guard forms a substantially convexly or concavely curved surface member which stands up or rather extends from the head support toward the baby's head when the head guard is in use.

A seventh embodiment provides a baby carrier according to the first to third embodiments, wherein the head guard is detachably fitted to the head support. At the time of fitting the head guard to the head support, the head guard extends from the front side of the head support that faces the baby's head or the head guard is fitted to the back side of the head support whereby the head guard has a substantially convexly of concavely curved surface configuration which extends toward the baby's head when the head guard is folded toward the front side of the head support. In both instances the head guard is capable of standing upright toward the top of a baby's head due to the folding along said curved surface and due to a core member inside the head guard which is positioned outside said curved surface.

An eighth embodiment provides a baby carrier according to the first to third embodiments, wherein the head guard comprises a first sweat-absorbent cushioning member placed on the front side of the head portion of the support where a baby's head comes to rest, a second cushioning member placed outside the first cushioning member for absorbing outside impacts, and a core member inserted between the first and second cushioning members.

A ninth embodiment provides a baby carrier according to the first to third embodiments, wherein at least either the head support or the head guard incorporates an air cushioning structure. The air cushioning structure comprises an air reservoir forming a predetermined space, and a shock absorbing portion surrounding the air reservoir for absorbing outside impacts by leaking the air in the air reservoir at the time of a deformation of the air reservoir due to an outside impact.

A tenth embodiment provides a baby carrier according to the ninth embodiment, wherein the shock absorbing portion includes as by-pass port communicating with the air reservoir.

An eleventh embodiment provides a baby carrier according to the ninth embodiment, wherein the shock absorbing portion includes a notch communication with the air reservoir.

A twelfth embodiment provides a baby carrier according to the ninth embodiment, wherein the shock absorbing portion is composed of porous material.

A thirteenth embodiment provides a baby carrier according to the first to third embodiments, wherein at least either the head support or the head guard incorporates a cushioning structure. The air cushioning structure comprises a first cushioning member having a plurality of first through holes, and a second and a third cushioning member at the opposite sides of the first cushioning member, said second and third cushioning members having a plurality of second and third through holes, respectively. The second and third through holes, without facing each other, communicate with the first through holes.

In a fourteenth embodiment, a head support for a baby carrier comprises a head support body for supporting a baby's head, which is releasably engagable with the baby carrier, and a head guard provided at the end of the head support body for protecting the top of a baby's head. The head guard extends toward the top of a baby's head.

A fifteenth embodiment provides a head support according to the fourteenth embodiment, wherein a belt section is provided at the outside of the head support body for guiding a carrying person's hand.

A sixteenth embodiment provides a head support according to the fourteenth embodiment, wherein the head guard is fixed to the backside of the head support body and wherein the head guard has a substantially convexly or concavely curved surface configuration. The head guard extends to the front side of the head support body when the head guard is folded toward the front side of the head support body.

A seventeenth embodiment provides a head support according to the fourteenth embodiment, wherein the head guard is detachably secured to the head support body. At the time of securing the head guard to the head support body, the head guard extends toward the front side of the head support body, or the head guard is fitted onto the back side of the head support body wherein the head guard has a substantially convexly or concavely curved surface. The head guard extends toward the front side of the head support body when the head guard is folded toward the baby's head.

An eighteenth embodiment provides a head support according to the fourteenth embodiment, wherein the head guard comprises a first sweat-absorbent cushioning member placed at the side of the top portion of a baby's head, a second cushioning member placed outside the first cushioning member for absorbing outside impacts, and a core member inserted between the first and second cushioning members.

A nineteenth embodiment provides a head support according to the fourteenth embodiment, wherein at least either the head support body or the head guard incorporates the air cushioning structure. The air cushioning structure comprises an air reservoir forming predetermined space, and a shock absorbing portion surrounding the air reservoir for absorbing an outside impact by leaking air in the air reservoir at the time of deformation of the air reservoir due to an outside impact.

A twentieth embodiment provides a head support according to the nineteenth embodiment, wherein the shock absorbing portion includes a by-pass port communicating with the air reservoir.

A twenty-first embodiment provides a head support according to the nineteenth embodiment, wherein the shock absorbing portion includes a notch communicating with the air reservoir.

A twenty-second embodiment provides a head support according to the nineteenth embodiment, wherein the shock absorbing portion is composed of porous material.

A twenty-third embodiment provides a head support according to the fourteenth embodiment, wherein at least either the head support body or the head guard incorporates an air cushioning structure. The air cushioning structure comprises a first cushioning member having a plurality of first through holes, and a second and a third cushioning member at opposite sides of the first cushioning member. The second and third cushioning members have a plurality of second and third through holes, respectively. The second and third through holes, without facing each other, communicate with the first through holes.

When using the baby carrier of the first embodiment of the invention, first, a baby is received and supported in the carrier body. Then, the head guard is raised up. In this case, the baby carrier is used as a lateral support type. At this time, the back of a baby's head is supported by the head support and the top of a baby's head is protected by the head guard.

The head guard in this upright condition can prevent a baby from falling down from the upper portion of the baby carrier.

When the present baby carrier is used as a longitudinal or vertical support, the head guard may be folded toward the back side of the head support, or the head guard may be removed from the head support as will be described in more detail below, whereby the back of a baby's head is supported by the head support.

Next, when the assembled baby carrier is switched from the vertical support to the lateral or horizontal support, the head guard is placed in a position extending away from the head support toward a baby's head. In other words, the head guard that was folded toward the back side of the head support is raised up, or the head guard that was removed from the head support is fitted to the head support and raised up. In contrast, when the assembled baby carrier is switched from the lateral or horizontal support to the longitudinal or vertical support, the head guard that extended toward a baby's head is folded toward the back side of the head support, or the head guard is removed from the head support.

In this way, according to the invention, the switching operation between the longitudinal or vertical support and the lateral or horizontal support type can be performed easily by operating the head guard, and a baby can be prevented from falling out of the baby carrier when the baby is supported sideways.

For holding a baby in the present baby carrier according to a second embodiment of the invention, first, a baby is placed on the carrier body. In this condition, the front cover portion is folded toward the baby's torso and the crotch cover portion is opened as a bag. Thereby, the baby carrier is made ready for use.

In use, the open crotch cover portion holds the baby's crotch firmly and a baby is prevented from falling down from the lower portion of the baby carrier while the baby carrier is being used.

When using the baby carrier as a lateral or horizontal support, the shoulder belts are placed on one shoulder of a carrying person with the head guard at the end of the head support in an extended position. At this time, the back of a baby's head is supported by the head support and the top of a baby's head is protected by the head guard. The head guard in this extended position prevents the baby from falling out of the upper portion of the baby carrier.

In addition, when using the baby carrier as a longitudinal or vertical support, the head guard is folded into a non-use position. In other words, the head guard is folded back toward the back side of the head support, or the head guard is removed from the head support. In this condition, the shoulder belts are cross-hung on a carrying person's shoulders. In this condition, the back of a baby's head is supported by the head support.

When the assembled baby carrier is switched from the longitudinal or vertical support to the lateral or horizontal support, it is merely necessary to simply raise up the head guard that was folded toward the back side, or fit the removed head guard to the head support and raise it up. When the assembled baby carrier is switched from the lateral or horizontal support to the longitudinal or vertical support, the head guard is simply folded in the extending position toward the back side of the head support, or the head guard is removed from the head support. In both cases, the shoulder belts can be used as they are by changing their placements on the carrying person's shoulders.

In this way, according to the second embodiment of the invention, the switching operation between the longitudinal support and the lateral support can be performed with ease by operating the head guard, and a baby is protected against falling out of the upper and lower portions of the baby carrier when it is held laterally or sideways.

For holding a baby in the baby carrier of a third embodiment of the invention, first, a baby is placed on the carrier body. In this condition, the front cover portion is folded toward the baby's torso and the hook members beside the front cover portion are engaged with the corresponding annular members on the back cover portion. Thereby, the crotch cover portion is formed as a bag to hold the baby's crotch. Next, first buckles of the shoulder belts are engaged with the second buckles beside the front cover portion to make the baby carrier ready for use.

In use, the crotch cover forming a bag holds the baby's crotch firmly and it protects the baby from falling down from the lower portion of the baby carrier while the baby carrier is being used.

When using the baby carrier as a lateral of horizontal support, the shoulder belts are bundled and placed on one shoulder of a carrying person while the head guard at the end of the head support is in the extended position. At this time, the back of a baby's head is supported by the head support and the top of a baby's head is protected by the head guard. The head guard in this extended condition prevents the baby from falling out of the upper portion of the baby carrier.

In addition, when using the baby carrier as a longitudinal or vertical support, the head guard at the end of the head support is folded toward the back side of the head support, or the head guard is removed from the head support. In this condition, the shoulder belts are cross-hung on the carrying person's shoulders. At this time, the back of a baby's head is supported by the head support.

When the assembled baby carrier is switched from the longitudinal or vertical support to the lateral or horizontal support type, it is merely necessary to simply raise up the head guard that was folded toward the back side of the head support, or fit the removed head guard to the head support and raise it up. When the assembled baby carrier is switched from the lateral or horizontal support to the longitudinal or vertical support, it is merely necessary to simply fold the standing head guard toward the back side of the head support, or to remove the head guard from the head support. In both cases, the shoulder belts can be used as they are by changing their placements on the carrying person's shoulders.

In this manner, according to the third embodiment of the invention, similarly to the case of the second embodiment, the switching operation between the lateral or horizontal support and the longitudinal or vertical support can be performed with ease by operating the head guard, and a baby is protected against falling out of the upper and lower portions of the baby carrier when it is held laterally or sideways.

The head support may be a separate element that is detachable from the carrier body or from the back cover portion, and a belt piece for guiding a nursing person's hand may be provided at the outside of the head support.

Preferably, the head guard is fixed to the back side of the head support. For this purpose the head guard has a substantially convex or concave surface configuration, and the head guard extends towards the front side of the head support when the head guard is folded forward whereby the top of a baby's head is protected by this extended head guard when a baby is supported sideways.

The head guard may be releasably engagable with the head support. In this case, the head guard is fitted onto the head support when the head guard is needed at the time of lateral supporting a baby.

At the time of fitting or securing the head guard to the head support, the head guard is extending toward the baby's head side or front side of the head support. Alternatively, the head guard is attached on the back side of the head support. For this purpose the head guard has a substantially convex or concave surface configuration, and the head guard extends toward the front side of the head support when the head guard is folded toward the baby's head side or front side.

Preferably, the head guard includes a first sweat-absorbent cushioning member placed to face the top of a baby's head, a second cushioning member for absorbing outside impacts is placed outside the first cushioning member, and a core member is inserted between the first and second cushioning members.

At least either the head support or the head guard preferably includes an air cushioning structure. The air cushioning structure may incorporate an air reservoir forming predetermined space and a shock absorbing portion, which surrounds the air reservoir and absorbs an outside impact by leaking air from the air reservoir when the air reservoir is deformed by an outside impact.

The shock absorbing portion may preferably have a by-pass port or a notch that communicates with the air reservoir, or the shock absorbing portion may be composed of porous material.

At least either the head support or the head guard preferably includes the air cushioning structure. The air cushioning structure may incorporate a first cushioning member having a plurality of first through holes, and second and third cushioning members at both sides of the first cushioning member having a plurality of second and third through holes, respectively. The second and third through holes, without opposing each other, communicate with the first through holes.

In this embodiment, because the second and third through holes of the second and third cushioning members do not oppose each other, an air resistance occurs in the air flow that leaks from the first through holes of the first cushioning member to the second and third through holes when an impact load is applied to the head support or the head guard whereby the first cushioning member is deformed. As a result, the impact load from outside is effectively absorbed.

According to the head support for the baby carrier of a fourth embodiment of the invention, the head support can be used as a lateral or horizontal support by raising the head guard at the end of the head support, whereby the back of a baby's head is supported by the head support and the top of a baby's head is protected by the head guard. The head guard in this extended position can prevent a baby from falling out of the upper portion of the baby carrier.

When using the head support as a longitudinal or vertical support, the head guard is folded toward the back side of the head support, or the head guard is removed from the head support, whereby the back of a baby's head is supported by the head support.

When the head support is switched from the longitudinal or vertical support to the lateral or horizontal support, the head guard is placed in its extended position by folding the head guard from its back side position to its extended front side position, or the head guard that was removed from the head support is secured to the head support and raised up. When the head support is switched from the lateral or horizontal support to the longitudinal or vertical support, the head guard is folded toward the back side of the head support, or the head guard is removed from the head support.

In this way, according to the fourth embodiment of the invention, the switching operation between the longitudinal or vertical support and the lateral or horizontal support is performed with ease by operating the head guard, and a baby is prevented from falling out of the baby's head side when the baby is supported sideways.

In addition, a belt piece for guiding a carrying person's hand may be provided at the outside of the head support.

Preferably, the head guard is fixed to the back side of the head support. For this purpose the head guard has a substantially convex or concave surface configuration, and the head guard extends toward the front side of the head support. Thereby, the top of the baby's head is protected by the extending head guard when the baby is supported sideways.

The head guard may be releasably connectable with the head support. In this case, the head guard is attached to the head support when the head guard is needed at the time when the carrier is used as a lateral or horizontal support.

At the time of attaching the head guard to the head support, the head guard extends toward the front side of the head support. Alternatively, when the head guard is secured to the back side of the head support the head guard has a substantially convex or concave surface configuration which permits folding the head guard from the back side position to the front side position in which the head guard extends toward a baby's head.

Preferably, the head guard includes a first sweat-absorbent cushioning member placed at the side of the top of a baby's head, a second cushioning member for absorbing outside impacts. The second cushioning member is placed outside the first cushioning member, and a core member is inserted between the first and second cushioning members.

At least either the head support body or the head guard preferably includes an air cushioning structure. The air cushioning structure may incorporate an air reservoir forming a predetermined space and a shock absorbing portion. The shock absorbing portion surrounds the air reservoir and absorbs an outside impact by leaking air in the air reservoir when the air reservoir is deformed by an outside impact.

The shock absorbing portion may preferably have a by-pass port or a notch that communicates with the air reservoir, or may be composed of porous material.

At least either the head support or the head guard preferably has an air cushioning structure. The air cushioning structure may incorporate a first cushioning member having a plurality of first through holes, and second and third cushioning members at both sides of the first cushioning member, said second and third cushioning members having a plurality of second and third through holes, respectively. The second and third through holes, without facing each other, communicate with the first through holes.

In this case, because the second and third through holes of the second and third cushioning members do not oppose each other, an air resistance occurs in the air flow that leaks from the first through holes of the first cushioning member to the second and third through holes when an impact load is applied to the head support or to the head guard whereby the first cushioning member is deformed. As a result, an impact load from outside is effectively absorbed.

DETAILED DESCRIPTION OF THE PREFERRED EMBODIMENTS

Figure 1:
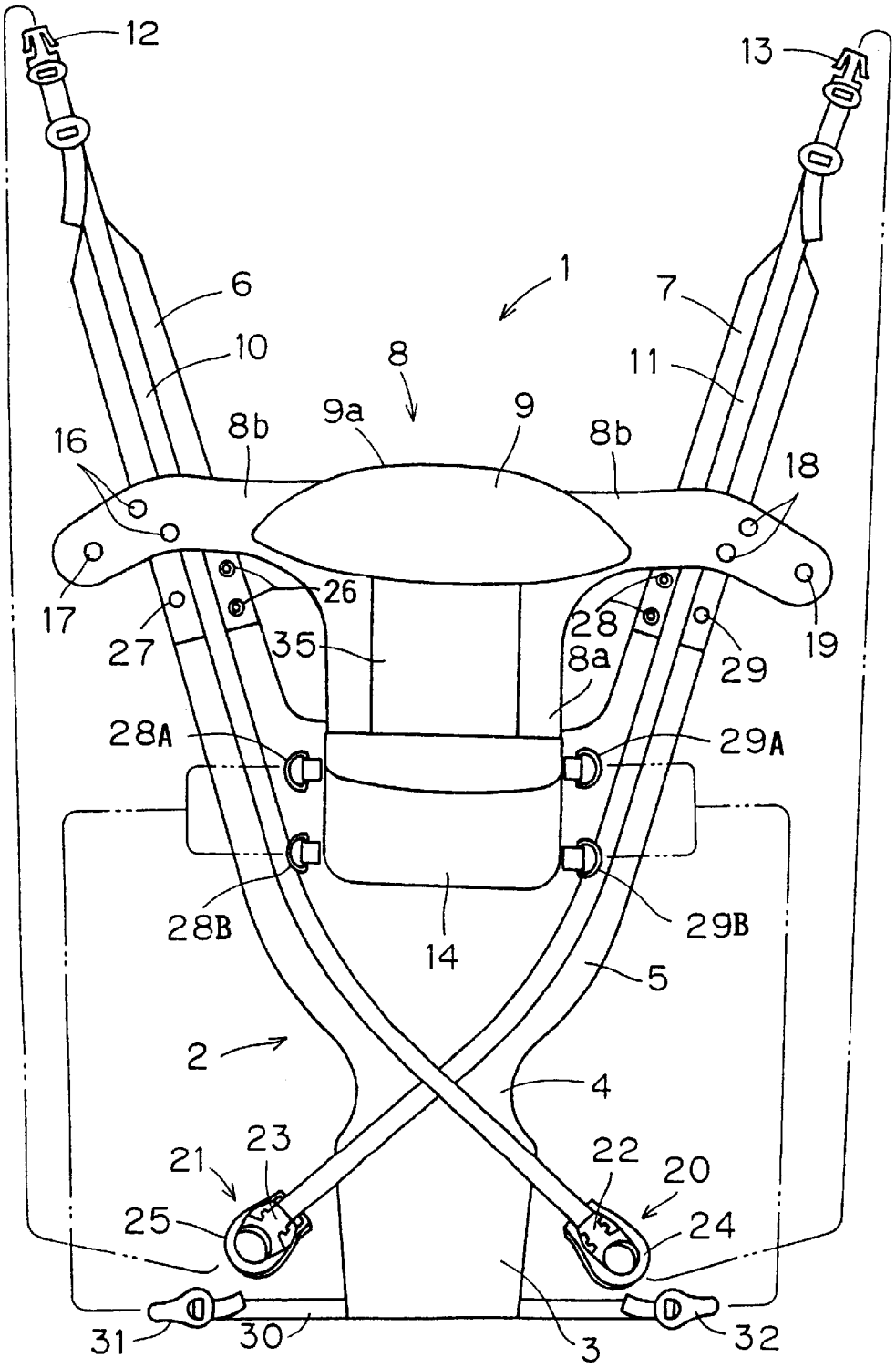
FIG. 1 is a front elevational view of a baby carrier, in an unfolded state, according to one embodiment of the present invention.
Figure 2:
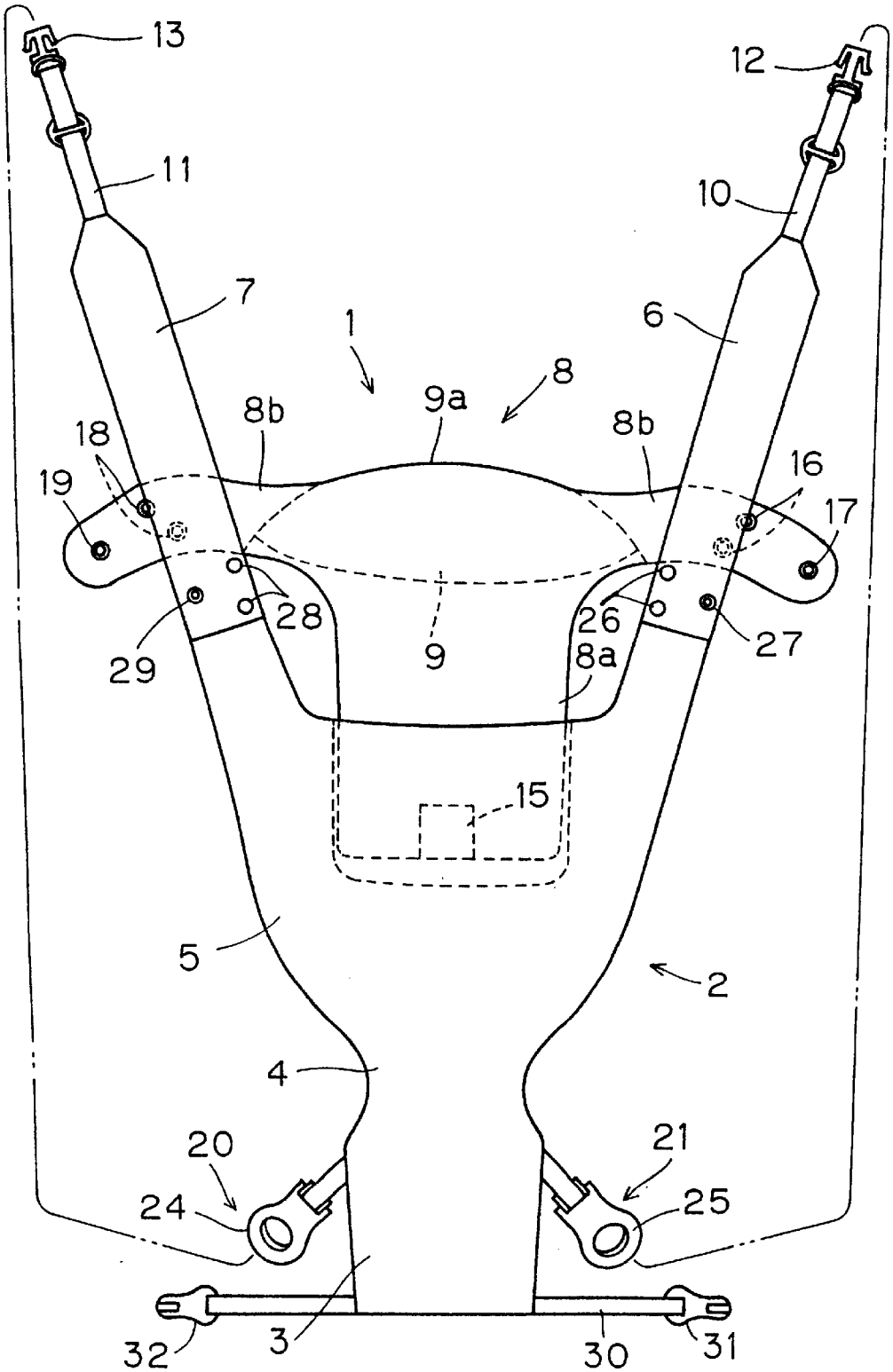
FIG. 2 is a back elevational view of the baby carrier of FIG. 1, in an unfolded state.

Referring now to the drawings, FIGS. 1–16 illustrate a baby carrier of the present invention. As shown in FIGS. 1 and 2, a baby carrier 1 includes a carrier body 2 having a front cover portion 3, a narrow crotch cover portion 4, and a back cover portion 5 for respectively supporting abdominal, crotch and back portion of a baby. The cover portions 3, 4, 5 are integrally formed as a one piece component.

The proximal ends of shoulder belts 6, 7 are connected to the opposite ends of the back cover portion 5. Upwardly extending belt members 10, 11 are sewn onto the shoulder belts 6, 7. The belt members 10, 11 run over the distal ends of the shoulder belts 6, 7 and extend further upwardly, and one-touch buckles 12, 13 are attached to the ends of the belt members 10, 11.

The belt members 10, 11 extend downwardly along the opposite ends of the back cover portion 5 and intersect with each other at the central part of the crotch cover portion 4 and extend further downwardly below the front cover portion 3. The belt members 10, 11 in the carrier body 2 are sewn onto the carrier body 2. The belt members 10, 11 may not be necessarily placed inside the carrier body 2.

Cover-equipped buckles 20, 21 are attached to the bottom ends of the belt members 10, 11. The buckles 20, 21 are composed of one-touch buckles 22, 23 for detachably engaging with the one-touch buckles 12, 13, respectively. Covers 24, 25 that can be opened or closed cover the operating parts of the one-touch buckles 22, 23, respectively.

Laterally extending belt members 30 are connected to the lower part of the front cover portion 3. Hook members 31, 32 are attached to the ends of the belt members 30. The hook members 31, 32 are able to detachably engage with pairs of D-shaped annular members 28A, 29A or 28B, 29B attached to the opposite sides of a pocket 14 on the back cover portion 5.

The annular members 28A, 29A are utilized mainly when the baby carrier 1 forms a lateral support. The annular members 28B, 29B are utilized mainly when the baby carrier 1 forms a longitudinal support. The number of annular members is not limited to this embodiment and multiple pairs of annular members for both lateral and longitudinal support may be provided.

A head support 8 for supporting a baby's head is provided on the upper end of the back cover portion 5. The head support 8 comprises a head support body 8*a* and band-like portions 8*b* extending laterally form the opposite ends of the head support body 8*a*. The lower part of the head support body 8*a* is inserted into the pocket 14 on the back cover portion 5 and is detachably attached to an adhesive cloth (or surface fastener) inside the pocket 14. Additionally, a belt piece 35 is provided on the head support body 8*a* for guiding a carrying person's hand when the baby carrier 1 is used as a lateral or horizontal support.

Snap fasteners 16, 17 and 18, 19 are respectively attached on the ends of the band-like portions 8*b*. The snap fasteners 16, 17 are detachably engagable with the snap fasteners 26, 27 fitted on the shoulder belt 6, and the snap fasteners 18, 19 are detachably engagable with the snap fasteners 28, 29 fitted on the shoulder belt 7. In addition, the snap fasteners 26–29 are provided at opposite ends of the upper end of the back cover portion 5.

A head guard 9 which generally has a semicircular shape is provided on the upper portion of the head support 8 for protecting the top of a baby's head. With the head guard 9 placed on the back surface of the head support 8, the convexly curved surface or connection area 9*a* at the top portion of the head guard 9 is sewn onto the top portion of the head support 8. Thereby, the sewn surface of the head guard 9 is curved convexly. In addition, this convexly curved surface area 9*a* is not necessarily a strict curved surface and may be polygonal in shape to provide a foldable connection between the head support 8 and the head guard 9.

Figure 3:
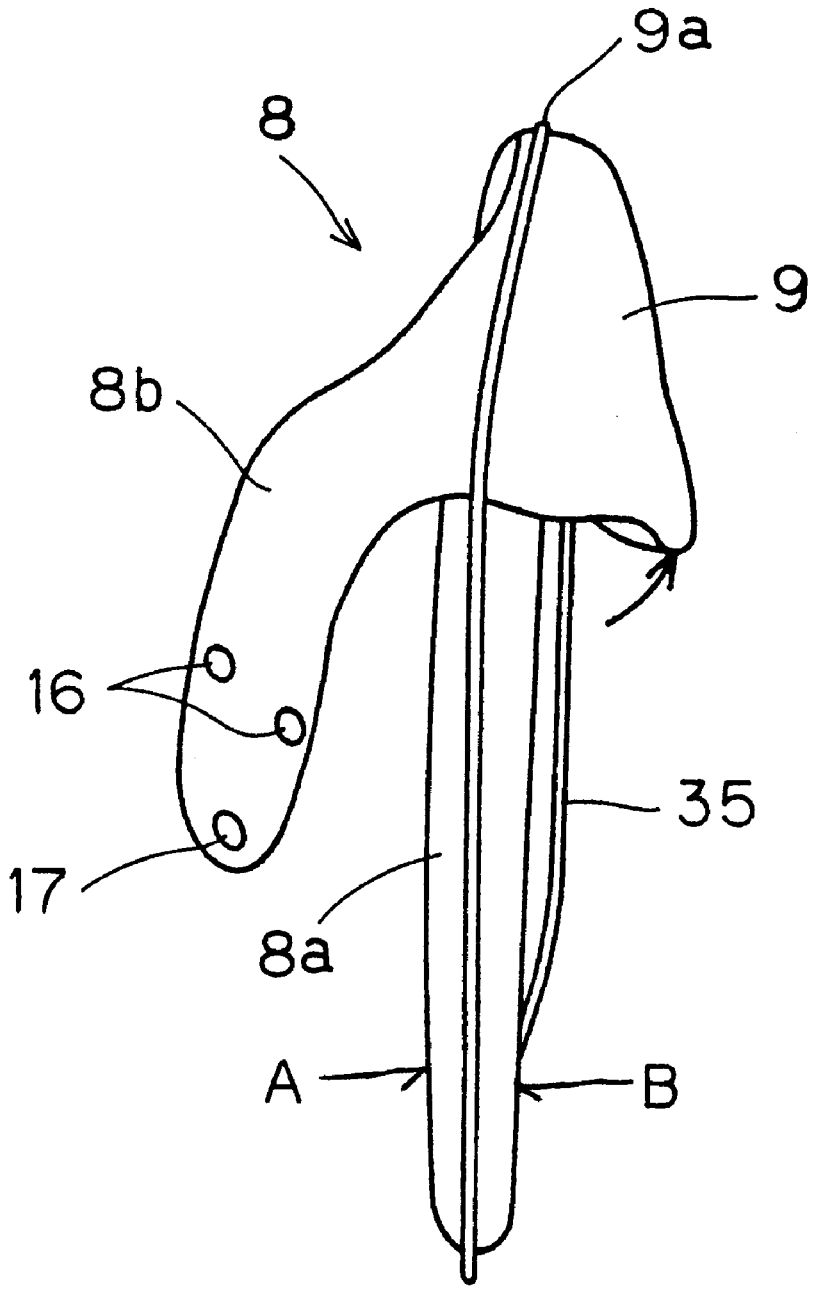
FIG. 3 is a side view of the head support and the head guard whereby the head guard is in the back folded non-use position.
Figure 4:
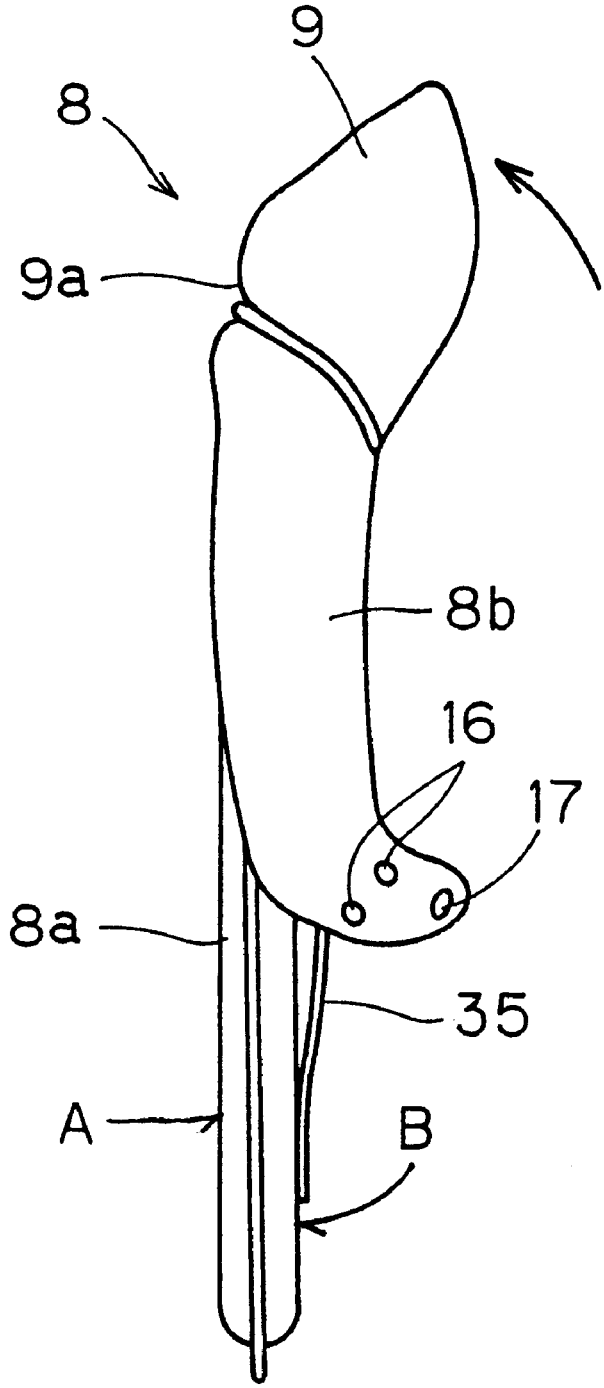
FIG. 4 is a side view of the head support and the head guard, whereby the head guard is folded partially toward the front side for using the carrier in an upright position.
Figure 5:
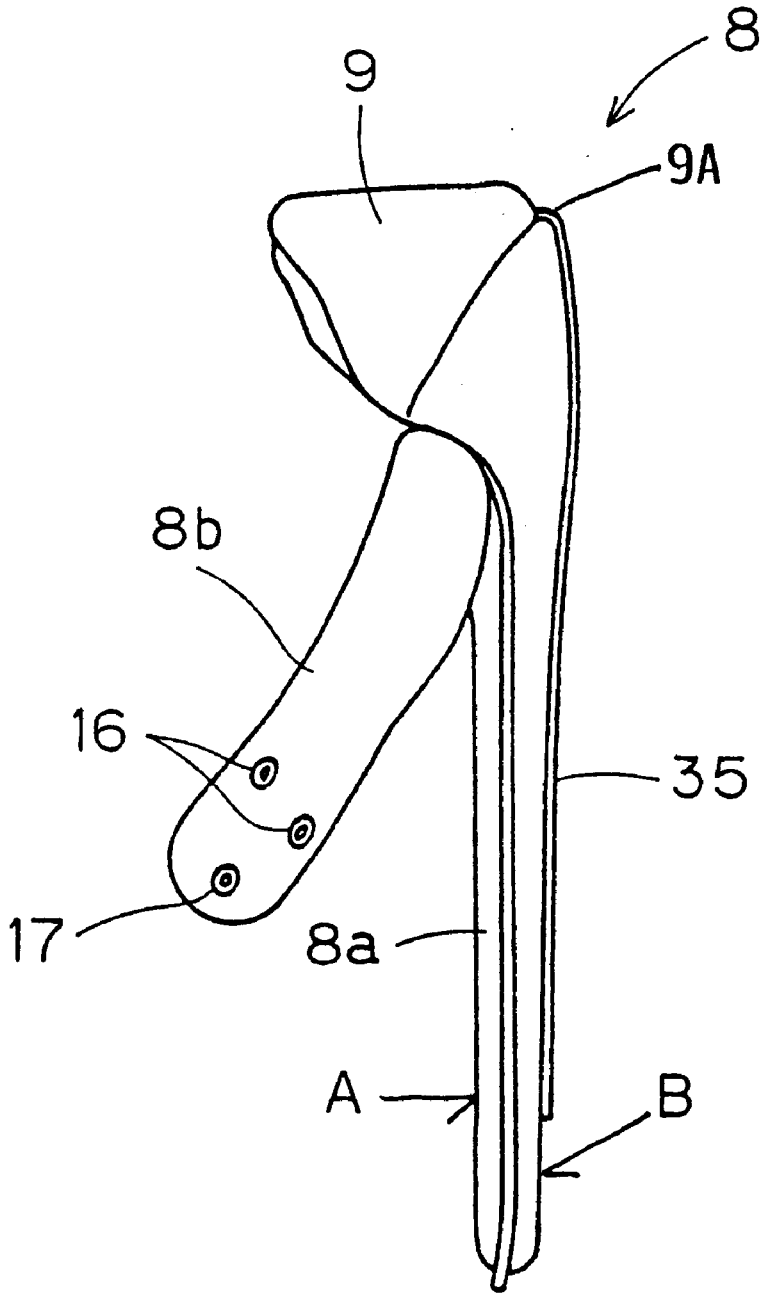
FIG. 5 is a side view of the head support and the head guard whereby the head guard is folded fully into a front side position when the carrier is used in a horizontal position.

The head support 8 and the head guard 9 will now be explained in detail. FIGS. 3–5 are the side views of the head support 8. In these Figs., a side A or the left side of the head support body 8*a* is a front side also referred to as a baby's side where a baby's head is placed. A side B is the back side of the head support 8. FIG. 3 shows the head guard 9 folded toward the back side of the head support 8 when the head guard is not used. FIG. 5 shows the head guard 9 folded toward the front or baby's side and raised up for use. FIG. 4 shows the head guard 9 folded into an intermediate position between the above-mentioned two positions, whereby the head guard may also be useful.

When changing the condition of the head guard 9 from a back folded condition shown in FIG. 3 to a stand-up or extended condition shown in FIG. 5, it is merely required to lift up the lower portion of the head guard 9 gradually in the arrow direction as seen in FIGS. 3 and 4 and to fold the head guard 9 toward the front side namely side A. In this condition, the head guard 9 extends toward the top of the baby's head as shown in FIG. 5 which is possible because the sewn surface 9*a* is curved convexly and foldable.

Figure 6:
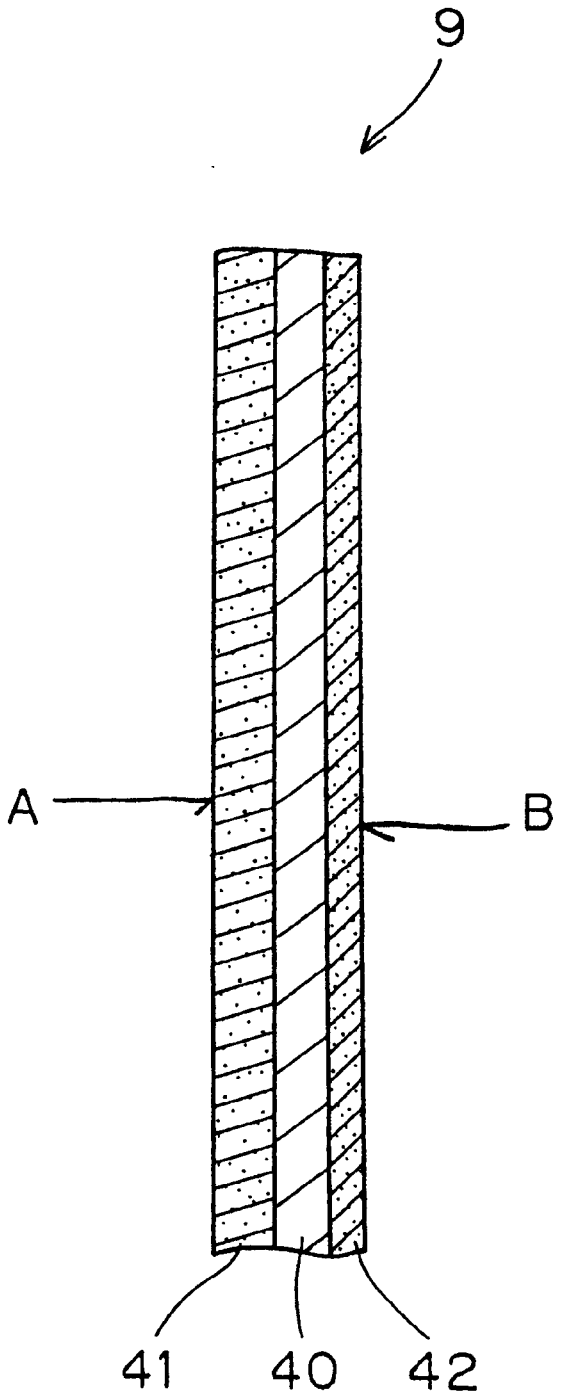
FIG. 6 is a cross sectional view through a portion of the head guard, illustrating the internal construction thereof.

FIG. 6 shows a cross-sectional view through a portion of the head guard 9. The side A in FIG. 6 shows the inside or the side where the top portion of a baby's head is placed with the head guard 9 raised up (see FIG. 5). Side B shows the opposite side or back side or the outside of the head guard 9.

As shown in FIG. 6, the head guard 9 comprises a hard, plate-like core member 40 which has the above mentioned convex or concave curved configuration depending on the view direction as best seen in FIGS. 3, 4 and 5. The above described folding of the head guard 9 takes place only at a junction area formed by the convexly formed surface 9*a*. The core member 40 does not extend into the junction area and hence does not hinder the folding or turning of the head guard. However, the core 40 keeps the head guard 9 in the position of FIG. 3 for protecting the top of the baby's head. A first sweat-absorbent cushioning member 41 is placed on the side A and a second cushioning member 42 for absorbing outside impacts is placed on the side B of the core member 40. The cushioning members 41, 42 may be composed of the same materials.

Figure 7:
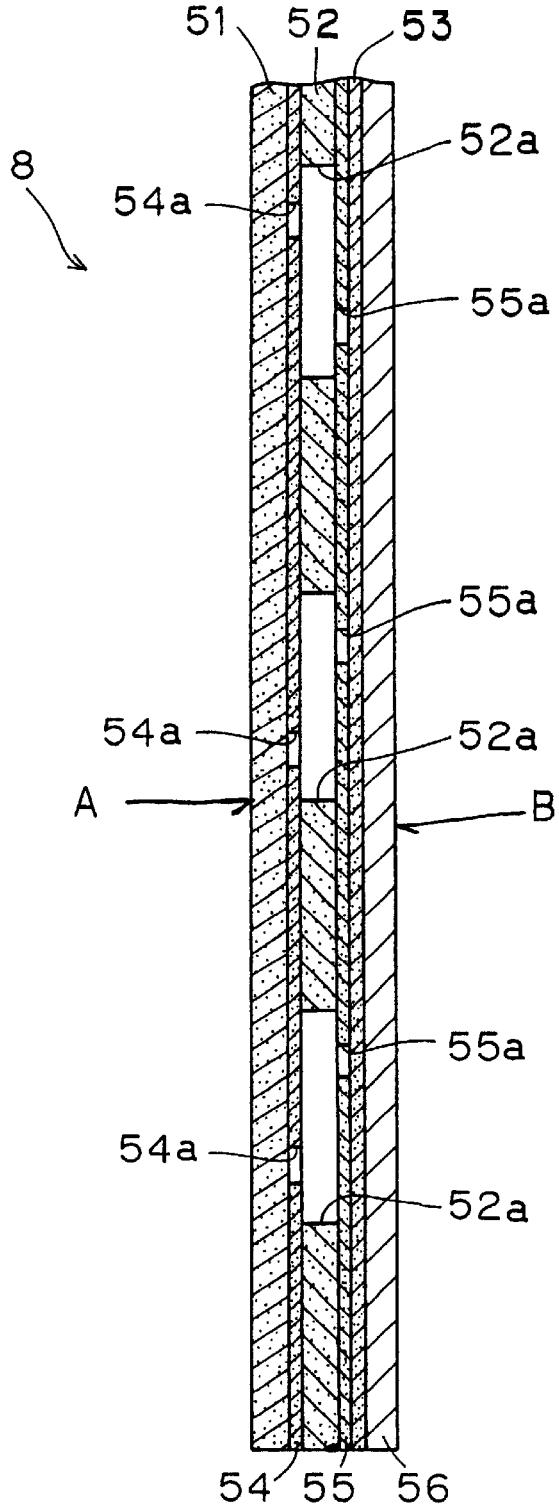
FIG. 7 is a cross sectional view of the head support, illustrating the internal construction thereof.

The head support 8, as shown in FIG. 7, comprises a five-layer structure. This five-layer structure includes cushioning members 51, 52, 53 made of polyurethane foam, for instance, for absorbing comparatively small impacts, and cushioning members 54, 55, which may be made of polyethylene foam, for instance, for absorbing comparatively large impacts and which are placed between cushioning members 51, 52, 53. A core member 56 is placed outside the cushioning member 53.

Such a five-layer structure softly supports a baby's head and effectively protects the head against various impacts from the outside.

Further, the air cushioning structure is positioned inside the head support 8. This air cushioning structure comprises a plurality of through holes 52*a* formed in the cushioning member 52, and a plurality of smaller through holes 54*a*, 55*a* formed in the cushioning members 54, 55, correspondingly to each of the through holes 52*a* on the cushioning member 52. The through holes 54*a* and 55*a* communicate with each other through the through holes 52*a* of the cushioning member 52, but they do not face each other.

Thereby, when each of the cushioning members is deformed by an impact load applied to the head support 8, an air resistance occurs in the air flow that leaks from the through holes 52*a* of the cushioning member 52 to the through holes 54*a*, 55*a* of the cushioning members 54, 55. As a result, the impact load from outside is effectively absorbed.

In addition, as an air cushioning structure for the head support 8, structures shown in FIGS. 8–11 may be employed. In the embodiments shown in these Figures, cushioning members 60, 70, 80, 90 are respectively used instead of cushioning members 52, 54, 55 in FIG. 7. The cushioning members 60, 70, 80 or 90 are formed integrally with each other.

Figure 8:
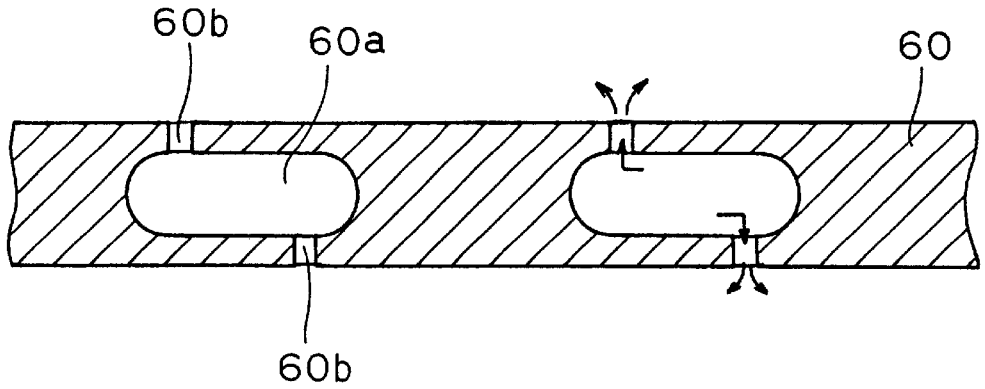
FIG. 8 is an enlarged view of a first alternative embodiment of FIG. 7.
Figure 9:
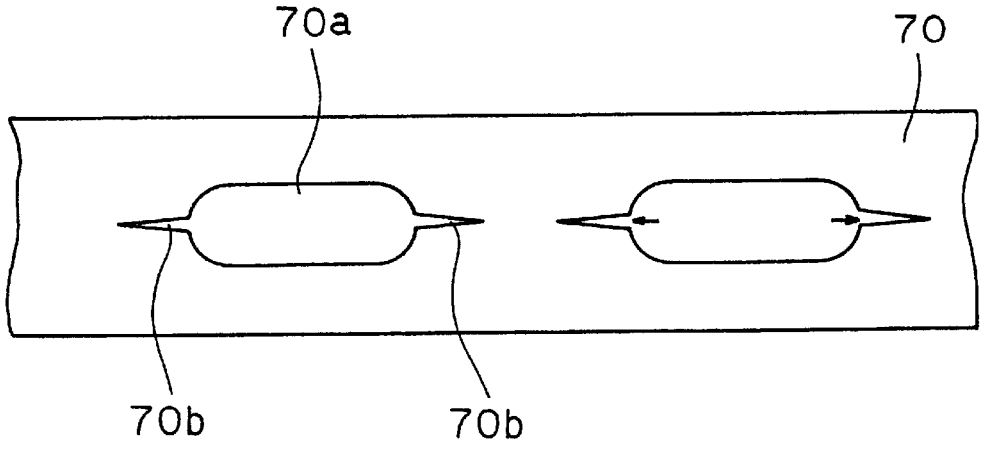
FIG. 9 is an enlarged view of a second alternative embodiment of FIG. 7.

In the embodiment shown in FIG. 8, a plurality of air reservoirs 60*a* are provided inside the cushioning member 60, and a pair of through holes 60*b* communicating with each of the air reservoirs 60*a* are formed in the member 60. In the embodiment shown in FIG. 9, a plurality of air reservoirs 70*a* are provided inside the cushioning member 70, and a pair of notches 70*b* are formed at the opposite sides of each of the air reservoirs 70 in the member 70.

Figure 10:
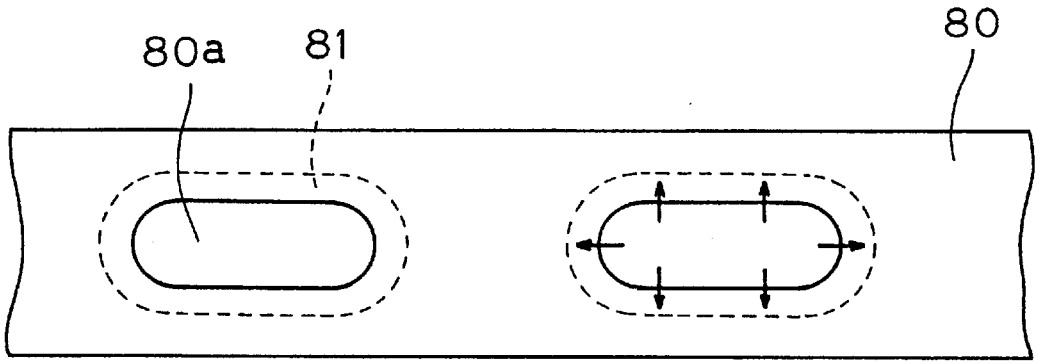
FIG. 10 is an enlarged view of a third alternative embodiment of FIG. 7.
Figure 11:
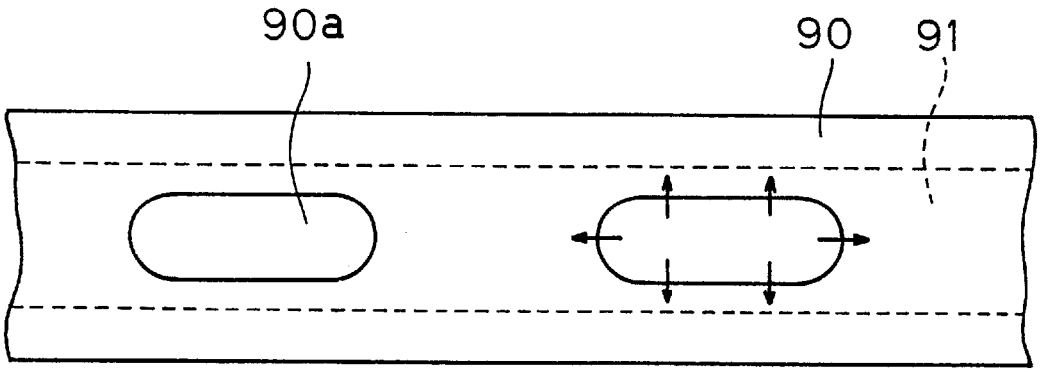
FIG. 11 is an enlarged view of a fourth alternative embodiment of FIG. 7.

In the embodiment shown in FIG. 10, a plurality of air reservoirs 80*a* are provided inside the cushioning member 80, and a porous member 81 is placed around each of the air reservoirs 80*a* in the member 80. In the embodiment shown in FIG. 11, a plurality of air reservoirs 90*a* are provided inside the cushioning member 90, and a porous member 91 is placed in a band-form around the air reservoirs 90*a* in the member 90.

In any cases, when the cushioning members are deformed by an applied impact load, the air in each of the air reservoirs 60*a*, 70*a*, 80*a*, 90*a* is transferred in the arrow direction whereby the air leaks through the through holes 60*b*, notches 70*b*, or porous members 81, 91 respectively for absorbing an impact load applied from outside.

The air cushioning structures shown in FIGS. 7–11 may also be employed for the head guard 9.

Prior to placing a baby in the baby carrier 1, snap fasteners 16–19 on a band-like portion 8*b* of the head support 8 are engaged with snap fasteners 26–29 on the shoulder belts 6, 7. In this condition, a baby is placed on the carrier body 2 namely on the side shown in FIG. 2 but facing away from the viewer.

Then, the front cover portion 3 is folded toward a baby's torso, and the hook members 31, 32 at the opposite ends of the belt member 30 are engaged with corresponding annular members 28A, 29A or 28B, 29B on the back cover portion 5, whereby, the crotch cover portion 4 is formed as a bag for supporting a baby's crotch (see FIG. 12), and thus, a baby is protected against falling down out of the lower portion of the baby carrier 1.

In addition, one may obey the following rules in determining which of the annular members 28A, 29A or 28B, 29B should be engaged with the hook members 31, 32.

When using the baby carrier 1 as a longitudinal or upright support, the hook members 31, 32 are engaged with the annular members 28A, 29A on the upper position of the back cover portion 5. In this case, the crotch opening of a baby can be enlarged, and thus, a baby can be held in the carrier body 2 without hurting the hip joint of a baby when it is held upright.

On the other hand, when using the baby carrier 1 as a lateral or horizontal support, the hook members 31, 32 are engaged with the annular members 28B, 29B on the lower position of the back cover portion 5. In this case, the center of gravity of a baby is placed in the lower portion in the bag shaped carrier body 2. Thus, a baby is steadily supported in the carrier body 2.

One-touch buckles 12, 13 on the shoulder belts 6, 7 are engaged with buckle devices 20, 21 positioned next to the front cover portion 3. The buckles devices 20, 21 comprise one-touch buckles 22, 23 and respective buckle covers 24, 25. When coupling these buckles 12, 22 and 13, 23 with each other the covers 24, 25 are open. When the coupling is completed, the covers 24, 25 are closed. In this way, the baby carrier 1 is made ready for use and a baby may now be held in the baby carrier 1 (see FIG. 12).

Figure 12:
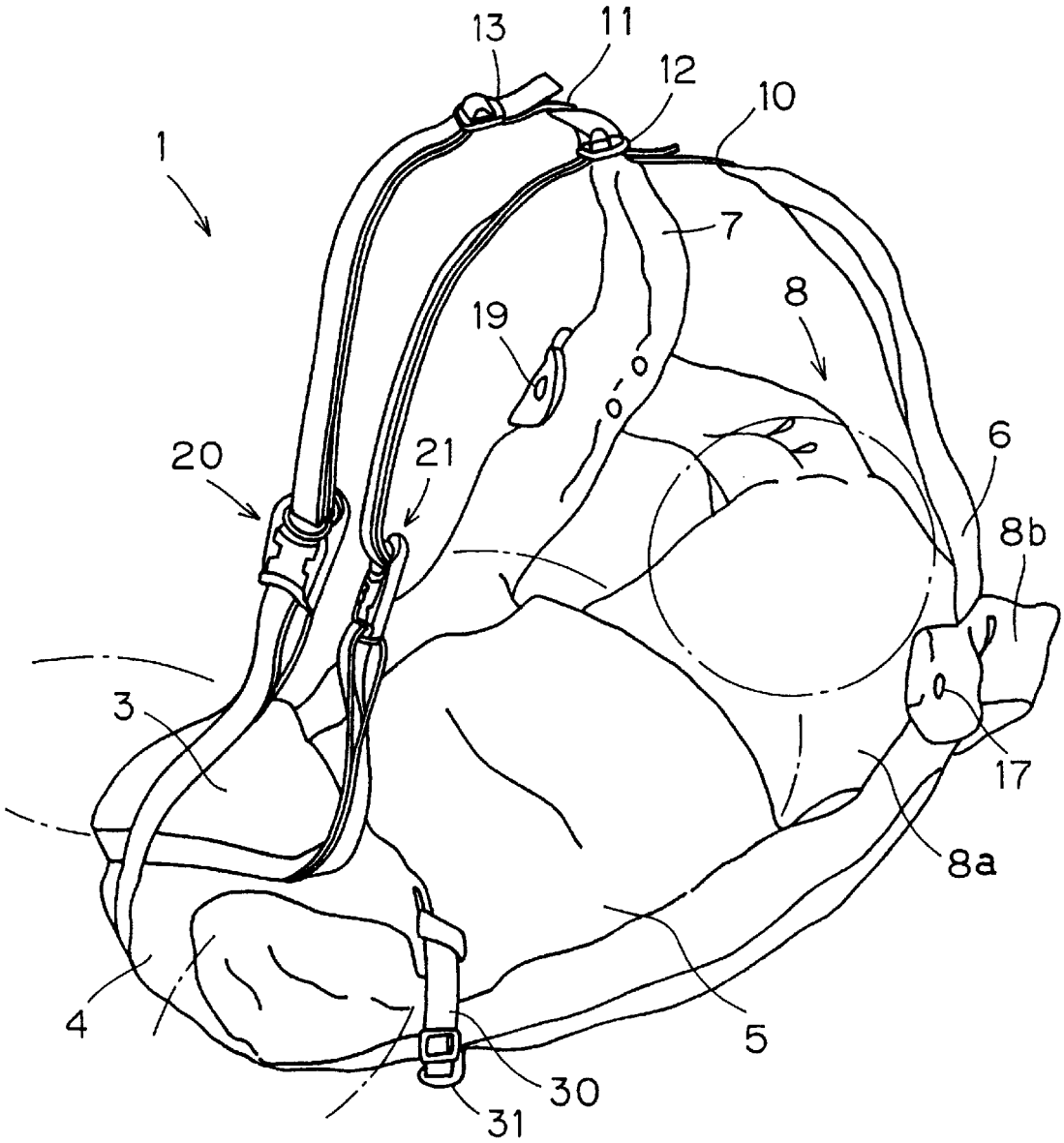
FIG. 12 is a perspective view showing the present baby carrier with a baby placed therein.
Figure 13:
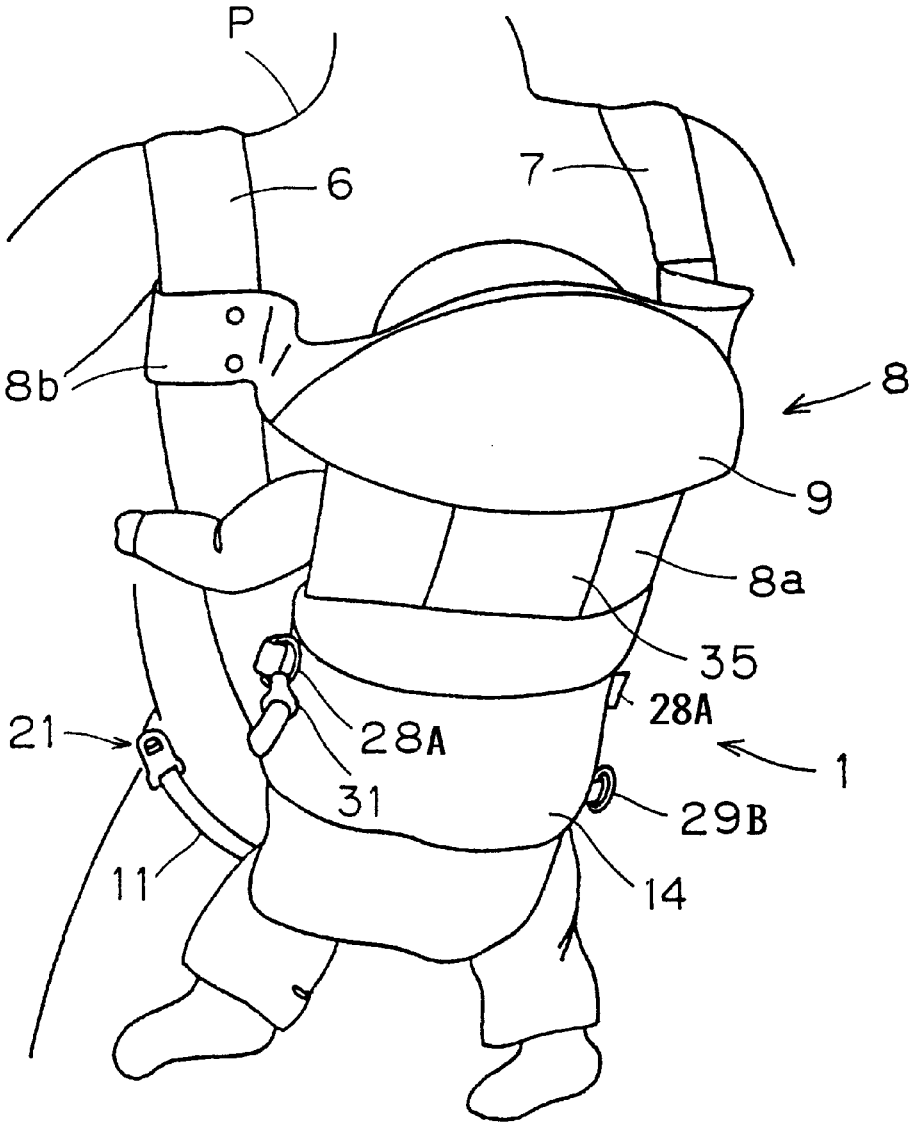
FIG. 13 is a perspective view of the present baby carrier in use as a longitudinal, or vertical, upright support.

Next, when using the baby carrier 1 as a longitudinal or upright support, from the condition shown in FIG. 12, the shoulder belts 6, 7 are hung on the shoulders of a carrying person P (see FIG. 13). At this time, the back portion of a baby's head is supported by the head support 8.

When using the baby carrier 1 in this upright position, preferably, the one-touch buckle 12 on the shoulder belt 6 is engaged with the cover-equipped buckle device 20 beside the front cover portion 3, and the one-touch buckle 13 on the shoulder belt 7 is engaged with the cover-equipped buckle device 21 also beside the front cover portion 3, which differs from the condition shown in FIG. 12. In this condition, the shoulder belts 6, 7 cross each other in a so-called cross-hung condition.

Figure 14:
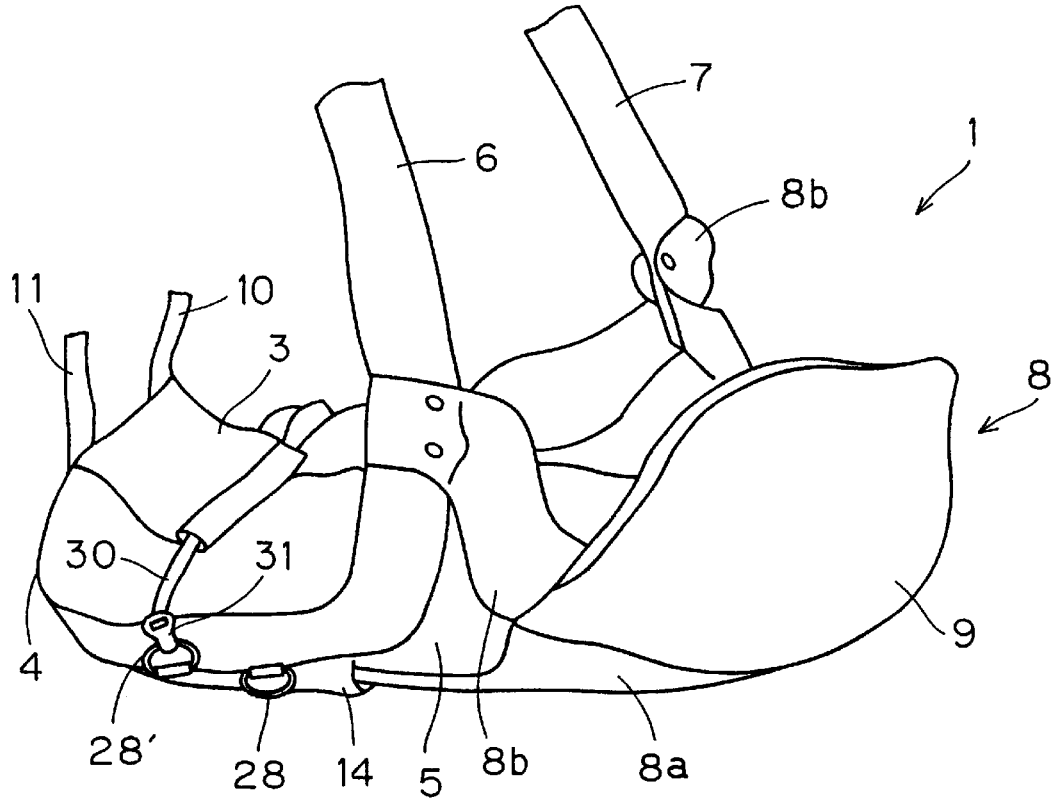
FIG. 14 is a schematic perspective view showing the present baby carrier as a lateral or horizontal support.

When using the baby carrier 1 as a lateral or horizontal support as shown in FIG. 12, the head guard is folded or turned toward the baby's side or front side and raised up (see FIGS. 3–5). As mentioned above, the sewn surface 9*a* of the head guard 9 is curved convexly and forms a sewn seam which enables the head guard 9 to keep its extended position as shown in FIGS. 5 and 14, since the core member does not extend into the seam formed along surface 9*a*.

Figure 15:
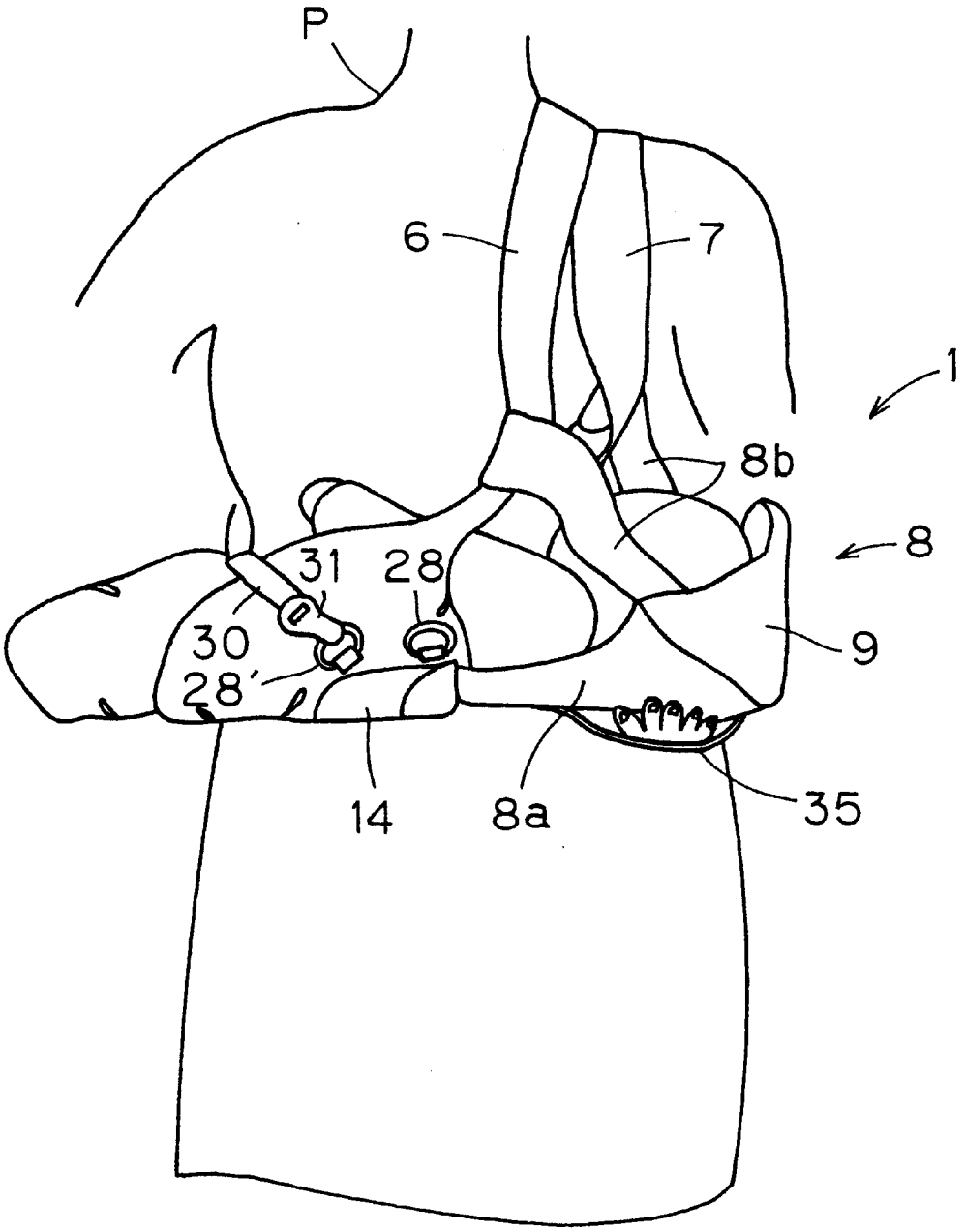
FIG. 15 is a perspective view of the present baby carrier in use as a lateral or horizontal support.

In this condition, the shoulder belts, 6, 7 are bundled and placed on one shoulder of a carrying person P (see FIG. 15). The back of a baby's head is supported by the head support 8 and the top of a baby's head is protected by the head guard 9. The head guard 9 in this extended condition can prevent a baby from falling out of the upper portion of the baby carrier 1.

In addition, when using the baby carrier 1 as a lateral or horizontal support, as shown in FIG. 15, a carrying person P may support a baby's head from the lower portion of the head support 8 with his/her hand inside the belt portion 35.

Then, when the assembled baby carrier 1 is changed from an up-right support to a lateral or horizontal support, it is merely necessary to simply raise up the head guard 9 that was folded toward the backside of the carrier. When the baby carrier 1 is changed from a lateral support to an upright support, it is merely necessary to simply fold the extended head guard 9 toward the backside. In both cases, the shoulder belts 6, 7 can be used as they are by changing their placements on the carrying person's shoulder.

In this way, the changing operation between an upright support and a lateral support can be performed with ease by raising or folding back the head guard 9.

Figure 16:
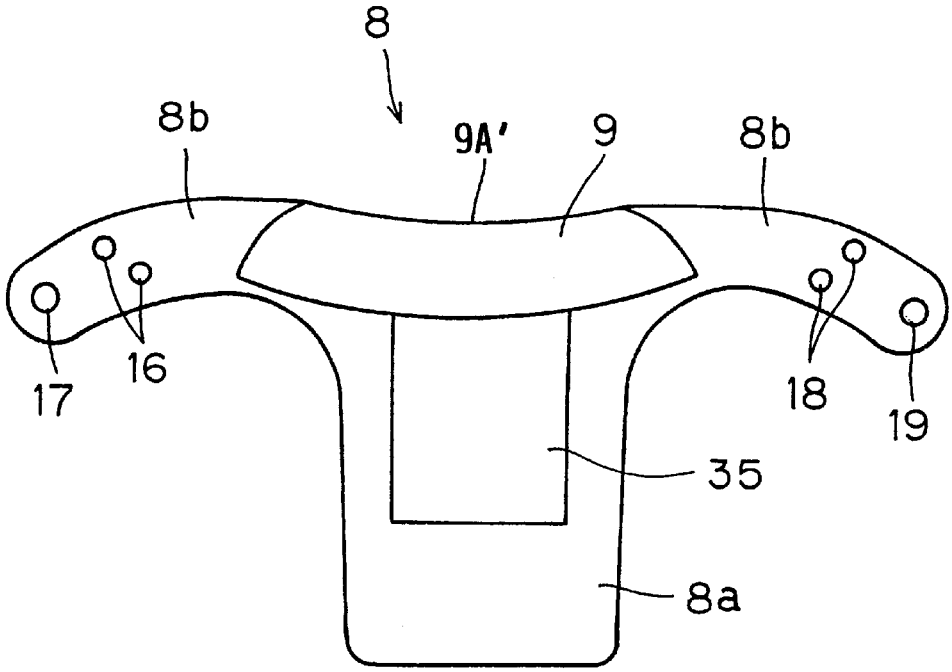
FIG. 16 is an enlarged view of an alternative embodiment of the head guard.
Figure 17:
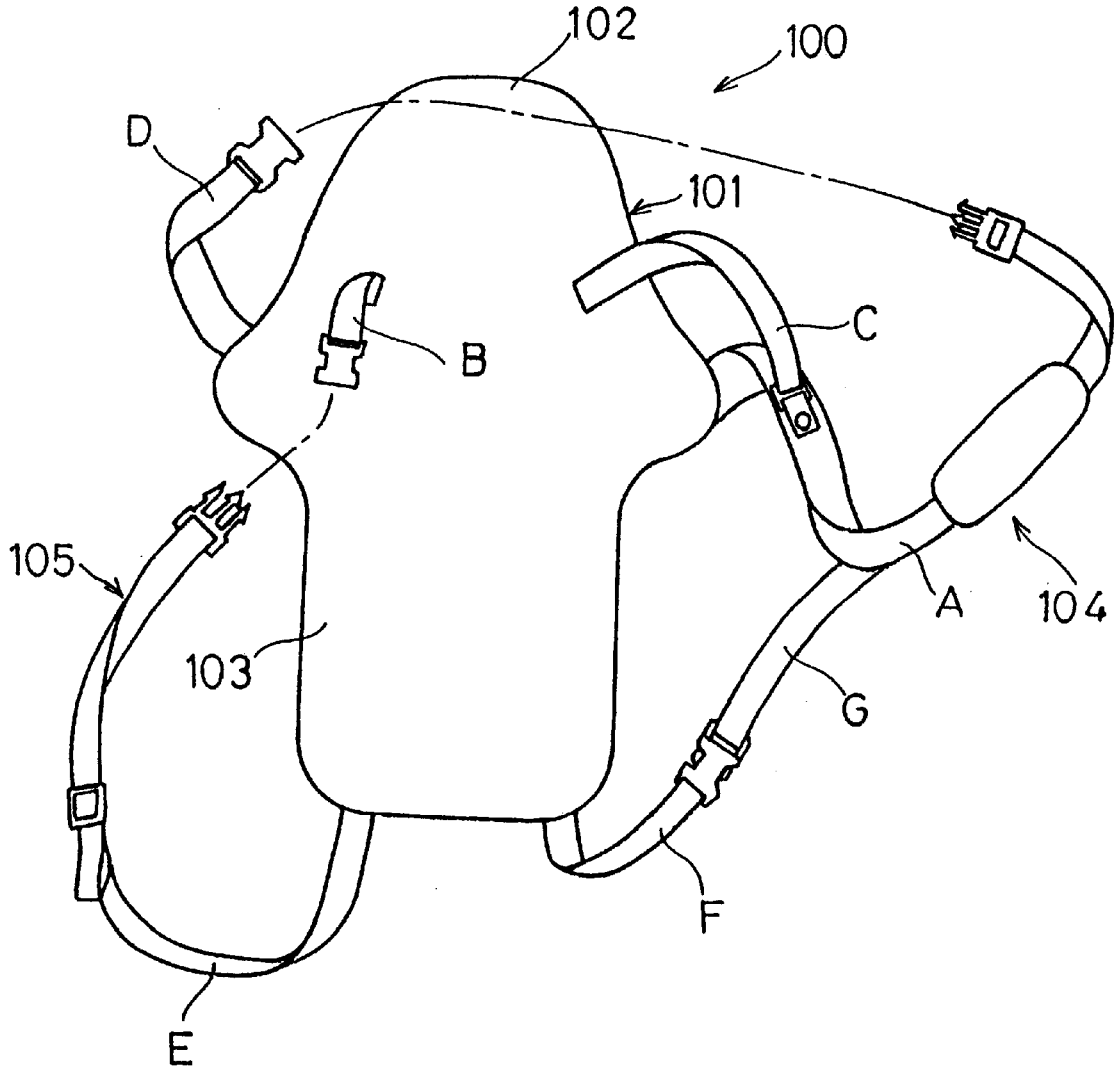
FIG. 17 is a schematic illustration of the way to fasten the belts of a conventional baby carrier in use as a lateral support.
Figure 18:
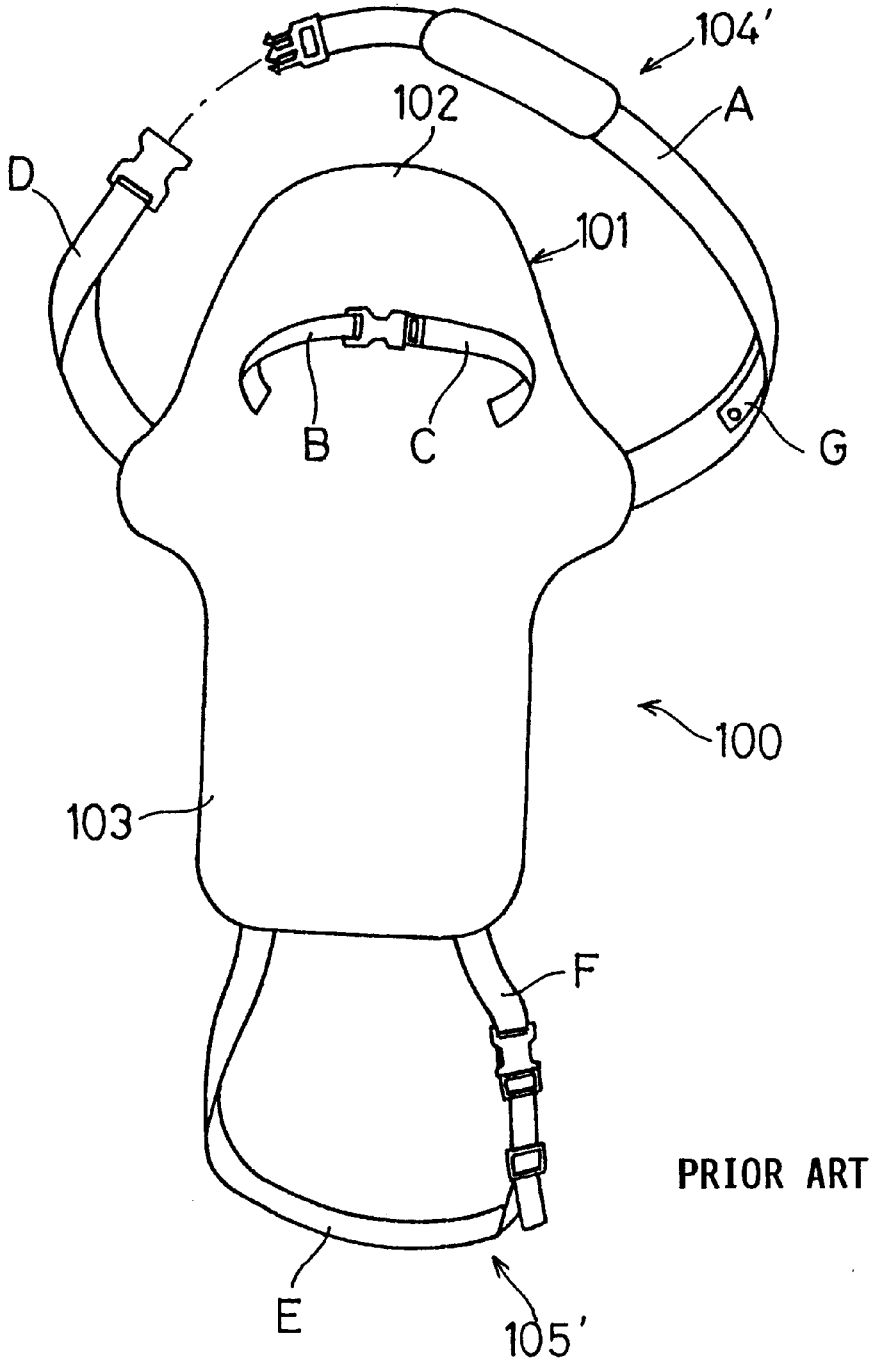
FIG. 18 is a schematic illustration of the way to fasten the belts of a conventional baby carrier in use as a longitudinal support.
Figure 19:
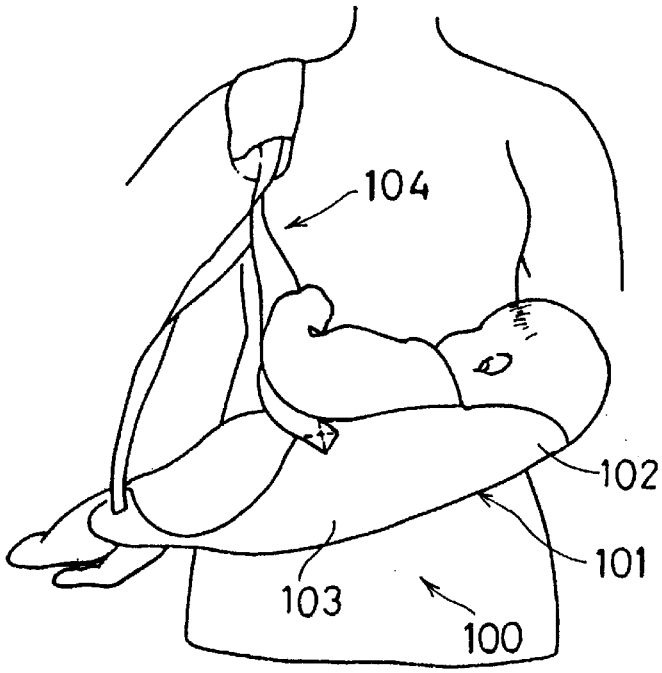
F I G. 19 PRIOR ART
FIG. 19 is a schematic illustration of a conventional baby carrier in use as a lateral support.
Figure 20:
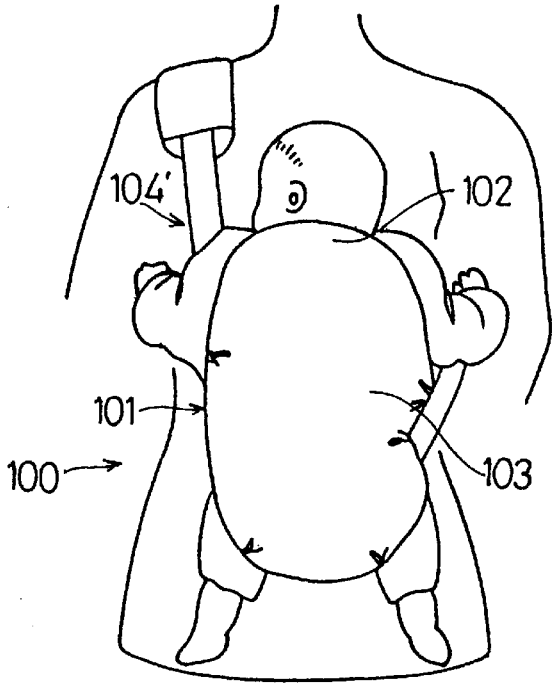
F I G. 20 PRIOR ART
FIG. 20 is a schematic illustration of a conventional baby carrier in use as a longitudinal support type.

In the above-mentioned embodiment, the head guard 9 has the convexly curved surface 9*a* at its upper end, which is joined to the upper end of the head support 8 by stitching. However, as shown in FIG. 16, a head guard 9 may have a concavely curved surface 9A' at its upper end, which may be joined to the concavely curved surface of the head support 8 by stitching.

In this case as well, the head guard 9 can be kept in the extended condition when it is folded toward a baby's side or front side. Additionally, in FIG. 16, the same reference numerals as are used in the above-mentioned embodiment indicate the same or equivalent elements as in the above-mentioned embodiments. The concavely curved surface 9A' may be polygonal in shape.

In the above-mentioned embodiment, the head guard 9 is fixed to the head support 8. However, the present invention is not limited to this embodiment.

The head guard 9 may be releasably secured to the head support 8 by detachable engaging members, such as snap fasteners, adhesive cloth and the like. In this case, the head guard 9 may be secured to the head support on the front side thereof in an extended position as shown in FIG. 5. When the head guard 9 is not needed it may be detached from the head support 8 without any folding or turning.

Alternatively, the head guard 9 may be secured to the back side of the head support 8 through a substantially convexly or concavely curved surface 9*a*. In this case, similarly to the above-mentioned embodiments, the head guard 9 stands up and maintains its extended position when it is folded back toward the front side of the head support 8.

Additionally, in the above-mentioned embodiment, although there is provided a carrier body where a front cover portion, a crotch cover portion and a back cover portion are integrally formed as a single piece, the present invention is not limited to such an embodiment.

The baby carrier 100 shown in FIGS. 17–20 has a carrier body 101 without a front cover portion and without a crotch cover portion. A headrest portion 102 of the carrier body 101 does not have any head guard. A bottom portion 103 alone does not prevent a baby from falling out of the carrier 100. Shoulder pads 104, 104' are attached to belts 105, 105' merely for the benefit of the carrying person but not for the benefit of the baby.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A baby carrier for supporting and carrying a baby therein, said baby carrier comprising:

a carrier body (2) including a front side for receiving a baby, a backside opposite said front side, a head end and a bottom end;

a head support (8) provided at said head end of said carrier body (2) for supporting a baby's head, said head support (8) having a curved outer end; and a head guard (9) provided at said curved outer end of said head support (8), said head guard (9) having a curved foldable connection (9*a*) between said head guard (9) and said curved outer end of said head support (8) for folding said head guard (9) into a first position overlapped with said head support and a second position raised from said head support (8), and means (40) inserted into said head guard (9) for holding said head guard (9) in said second raised position for protecting the top of a baby's head.

2. The baby carrier of claim 1, wherein said carrier body (2) further comprises a front cover portion (3), a narrow crotch cover portion and a back cover portion, which are integrally formed as a one piece structure, for supporting a baby's abdomen, crotch, and back, respectively, wherein said front cover portion is folded toward said back cover portion and said crotch cover portion is formed as a bag configuration, said baby carrier further comprising a shoulder belt securable to said carrier body; wherein said head support (8) is provided at said back cover portion for supporting a baby's head.

3. The baby carrier of claim 1, wherein said carrier body further comprises a front cover portion, a narrow crotch cover portion and a back cover portion, which are integrally formed as a one piece structure for supporting a baby's abdomen, crotch, and back, respectively; said back cover portion comprising opposite back ends, a pair of shoulder belts securable to said opposite back ends of said back cover portion;

first buckle members provided at distal ends of said shoulder belts, said front cover portion comprising opposite front ends;

second buckle members provided at said opposite front ends of said front cover portion, said second buckle members being releasably engageable with said first buckle members;

hook members provided at said opposite front ends of said front cover portion, and at least a pair of annular members provided at said back cover portion, said annular members being releasably engageable with said hook members at said opposite front ends of said front cover portion.

4. The baby carrier of claim 1, further comprising means for releasably connecting said head support (8) to said head end of said carrier body.

5. The baby carrier of claim 1, further comprising a belt piece provided at an outside of said head support (8) for guiding a person's hand.

6. The baby carrier of claim 1, wherein said head support (8) comprises a front (A) and a back (B), wherein said head guard (9) is fixed to said back (B) of said head support (8) along said curved foldable connection (9A) for folding said head guard (9) into said raised position on said front (A) of said head support (8).

7. The baby carrier of claim 1, wherein said head guard (9) is detachably secured to said head support (8) along said curved foldable connection (9A) for folding said head guard (9) into said raised position on said front (A) of said head support (8).

8. The baby carrier of claim 1, wherein said head guard (9) comprises a first sweat-absorbent cushioning member placed to cover said top of a baby's head, a second cushioning member placed outside said first cushioning member for absorbing outside impacts, and wherein said means for holding said head guard (9) in said raised position comprise a core inserted between said first and second cushioning member.

9. The baby carrier of claim 1, further comprising an air cushioning structure included in one of said head support (8) and said head guard (9), said air cushioning structure comprising an air reservoir forming a predetermined space, and a shock absorbing portion surrounding said air reservoir for absorbing an outside impact by leaking air into said predetermined space of said air reservoir in response to a deformation of said air reservoir by an outside impact.

10. The baby carrier of claim 9, wherein said shock absorbing portion includes a by-pass port communicating with said predetermined space in said air reservoir.

11. The baby carrier of claim 9, wherein said shock absorbing portion includes a notch communicating with said predetermined space in said air reservoir.

12. The baby carrier of claim 9, wherein said shock absorbing portion is made of a porous material.

13. The baby carrier of claim 1, further comprising an air cushioning structure included in one of said head support (8) and said head guard (9), said air cushioning structure comprising a first cushioning member having a plurality of first through holes, and a second and a third cushioning member positioned on opposite sides of said first cushioning member, said second and third cushioning members having a plurality of second and third through holes, respectively, said second and third through holes, without opposing each other, communicating with said first through holes.

14. A head support for a baby carrier for supporting and carrying a baby in said baby carrier, said head support comprising: a head support body (8) for supporting a baby's head, said head support body including means for releasably attaching said head support body (8) to said baby carrier; a head guard (9) provided at an end of said head support body for protecting the top of a baby's head, a curved foldable connection (9A) between said head guard (9) and said head support body for folding said head guard (9) into a raised position and means for holding said head guard in said raised position for protecting said top of a baby's head.

15. The head support of claim 14, further comprising a belt piece provided at an outside of said head support body (8) for guiding a person's hand.

16. The head support of claim 14, wherein said head support body comprises a front (A) and a back (B), wherein said head guard (9) is fixed to said back (B) of said head support (8) along a curved connection surface area (9A) for folding said head guard (9) into said raised position on said front (A) of said head support (8).

17. The baby carrier of claim 14, wherein said head guard (9) is detachably secured to said head support (8) along a curved connection surface area (9A) for folding said head guard (9) into said raised position on said front (A) of said head support (8).

18. The baby carrier of claim 14, wherein said head guard (9) comprises a first sweat-absorbent cushioning member placed to cover said top of a baby's head, a second cushioning member placed outside said first cushioning member for absorbing outside impacts, and wherein said means for holding said head guard (9) in said raised position comprise a core inserted between said first and second cushioning member.

19. The baby carrier of claim 14, further comprising an air cushioning structure included in one of said head support (8) and said head guard (9), said air cushioning structure comprising an air reservoir forming a predetermined space, and a shock absorbing portion surrounding said air reservoir for absorbing an outside impact by leaking air into said predetermined space of said air reservoir in response to a deformation of said air reservoir by an outside impact.

20. The baby carrier of claim 19, wherein said shock absorbing portion includes a by-pass port communicating with said predetermined space in said air reservoir.

21. The baby carrier of claim 19, wherein said shock absorbing portion includes a notch communicating with said predetermined space in said air reservoir.

22. The baby carrier of claim 19, wherein said shock absorbing portion is made of a porous material.

23. The baby carrier of claim 14, further comprising an air cushioning structure included in one of said head support (8) and said head guard (9), said air cushioning structure comprising a first cushioning member having a plurality of first through holes, and a second and a third cushioning member positioned on opposite sides of said first cushioning member, said second and third cushioning members having a plurality of second and third through holes, respectively, said second and third through holes, without opposing each other, communicating with said first through holes.

* * * * *